US005259421A

United States Patent [19]

Alexander, III et al.

[11] Patent Number: 5,259,421

[45] Date of Patent: Nov. 9, 1993

[54] WEAVING MACHINE FEEDING APPARATUS WITH OSCILLATING DANCER ROLL

[75] Inventors: William J. Alexander, III, Mauldin; Shala W. Summey, III, Greenville, both of S.C.

[73] Assignee: Alexander Machinery, Inc., Mauldin, S.C.

[21] Appl. No.: 967,179

[22] Filed: Oct. 27, 1992

[51] Int. Cl.[5] ..... D03D 49/06

[52] U.S. Cl. ..... 139/110; 139/103; 226/42; 226/44

[58] Field of Search ..... 226/42, 44; 139/103, 139/115, 109, 110

[56] References Cited

U.S. PATENT DOCUMENTS

| | | | |
|---|---|---|---|
| 3,807,613 | 4/1974 | Holm | 226/42 |
| 3,966,106 | 6/1976 | Randpalu | 226/44 X |
| 4,407,331 | 10/1983 | Rehling et al. | 139/110 |
| 4,750,527 | 6/1988 | Rehling | 139/110 |
| 4,896,808 | 1/1990 | Bolza-Schunemann et al. | 226/42 |

*Primary Examiner*—Andrew M. Falik
*Attorney, Agent, or Firm*—Ralph Bailey

[57] ABSTRACT

Apparatus for feeding warp yarns to a weaving machine has a driven yarn tensioning roll (A) over which passes the warp yarn as it is pulled from a supply into the weaving machine. Thereafter, the warp yarn passes over a dancer roll (B) and a guide (C). A motor (D) drives the roll (A) for rotation responsive to oscillation of the dancer roll (B) resulting from yarn tension. Power operated apparatus (E) including fluid operated cylinders move the dancer roll and guide away from the yarn tensioning roll (A) to permit quick thread up of the weaving machine. By providing a second driven yarn tensioning roll and associated elements it is possible to more effectively mix warp yarns being fed into the weaving machine. A potentiometer (F) is driven by oscillation of the dancer roll for controlling the speed of the motor (D).

9 Claims, 4 Drawing Sheets

WEAVING MACHINE FEEDING APPARATUS WITH OSCILLATING DANCER ROLL

BACKGROUND OF THE INVENTION

This invention relates to an improved warp yarn feeder of the type utilizing a driven roll for controlling tension as by holding back the warp yarn being pulled into the weaving machine.

Control of the tension on warp yarns being fed into a weaving machine has long been a problem especially when weaving heavy fabrics such as tire cord, duck fabric and the like. Heretofore, it has been the general practice to adjust the speed of the motor which drives the roll over which yarn is passed on its way to the weaving machine together with adjusting the speed of the weaving machine motor and the takeup motor. Such apparatus was of limited usefulness because of the difficulty in coordinating the action of the three motors together with sensing and exerting a positive control upon the tension on the warp yarns. The problem has persisted of maintaining constant and even tension across a web or sheet of warp yarns. Another difficulty has been the threading up of the feeding apparatus to the weaving machine because of the necessary step of passing the warp yarns over guide rolls and the driven roll for passage thence to the weaving machine.

Moreover, it is also desirable to be able to mix the types and styles of the yarns making up the warp yarn of a desired fabric and such may be accomplished if it were possible to accommodate a dual supply of warp yarns.

SUMMARY OF THE INVENTION

Accordingly, it is an important object of this invention to provide an improved apparatus for feeding warp yarn as a web or sheet to a weaving machine which is capable of maintaining constant and even tension through the use of a dancer roll.

Another important object of the invention is the provision of a control apparatus for varying the speed of a motor which drives the roll over which the yarn is fed prior to its passage to the dancer roll which, by means of the oscillatory movement of the dancer roll in response to variations in warp tension. The movement of the dancer roll drives a control mechanism such as a potentiometer for varying the speed of the drive to the roll over which the yarn passes.

Another important object of the invention is the provision of a driven roll or tension roll over which the yarn passes having means for guiding yarn thereover and a dancer roll which receives the yarn after it passes over the driven roll. Such means are positively separated by power operated apparatus to permit an eye board which has already been threaded up with warp yarn to be received therebetween for threading up the feeder transporting the warp to the weaving machine.

Still other important objects of the invention are accomplished by providing for a dual source of warp yarn having stacked webs or sheets of warp yarn and, driven rolls with respective associated parts as described herein as in a warp feeding machine carried by a feeder stand positioned between a supply of warp yarn and the weaving machine to facilitate mixing of various styles and types of yarn for feeding into weaving machines for weaving a desired fabric.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate apparatus for feeding warp yarn from a supply as a sheet into a weaving machine having an upright frame positioned rearwardly of the weaving machine. A driven yarn tensioning roll A is carried for rotation by the frame for tensioning warp yarn pulled thereover from the supply into the weaving machine. A dancer roll B mounted for oscillatory movement receives the warp yarn from the driven roll. A guide C illustrated in the form of a roll positions the warp yarn under the drive or tension roll. A motor D drives the roll A for rotation responsive to oscillatory movement of the dancer roll applying tension to the warp yarn. Power operated apparatus E moves the dancer roll and the guide away from the roll A for threading the warp yarns as a web therebetween to the weaving machine. A second roll A' carried by the frame receives a web from a second supply of warp yarn. Likewise, a second dancer roll B', guide C' and motor D' are provided together with second power operated apparatus E'. Use of such dual system described herein facilitates mixing yarns.

Constant and even controlled tension is exerted across the web of warp yarns, and threading up of the loom is facilitated.

Figure 1:
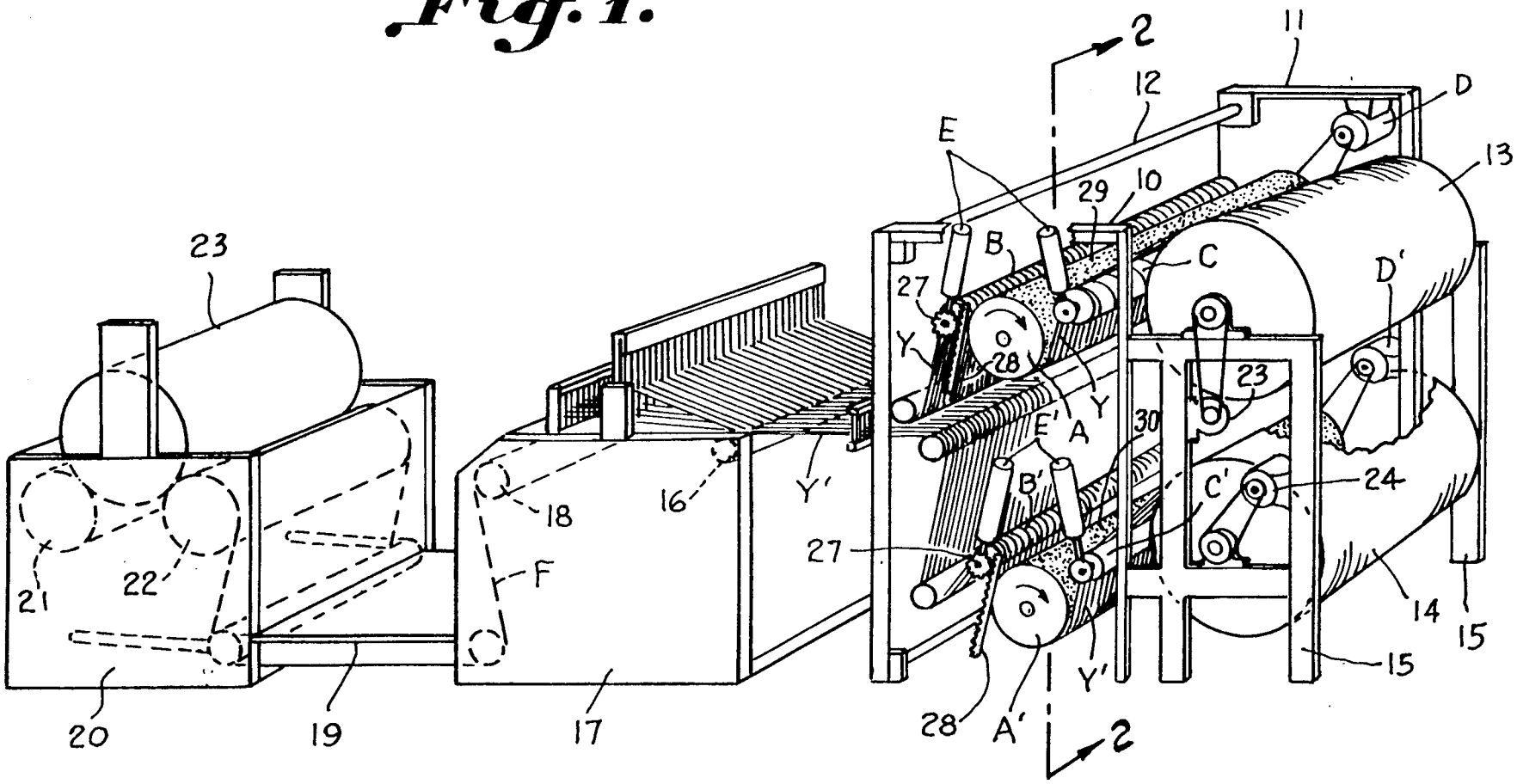
FIG. 1 is a perspective view illustrating a yarn feeder constructed in accordance with the present invention for feeding warp yarn as a web to a weaving machine from whence the woven fabric is transported to a takeup mechanism.
Figure 2:
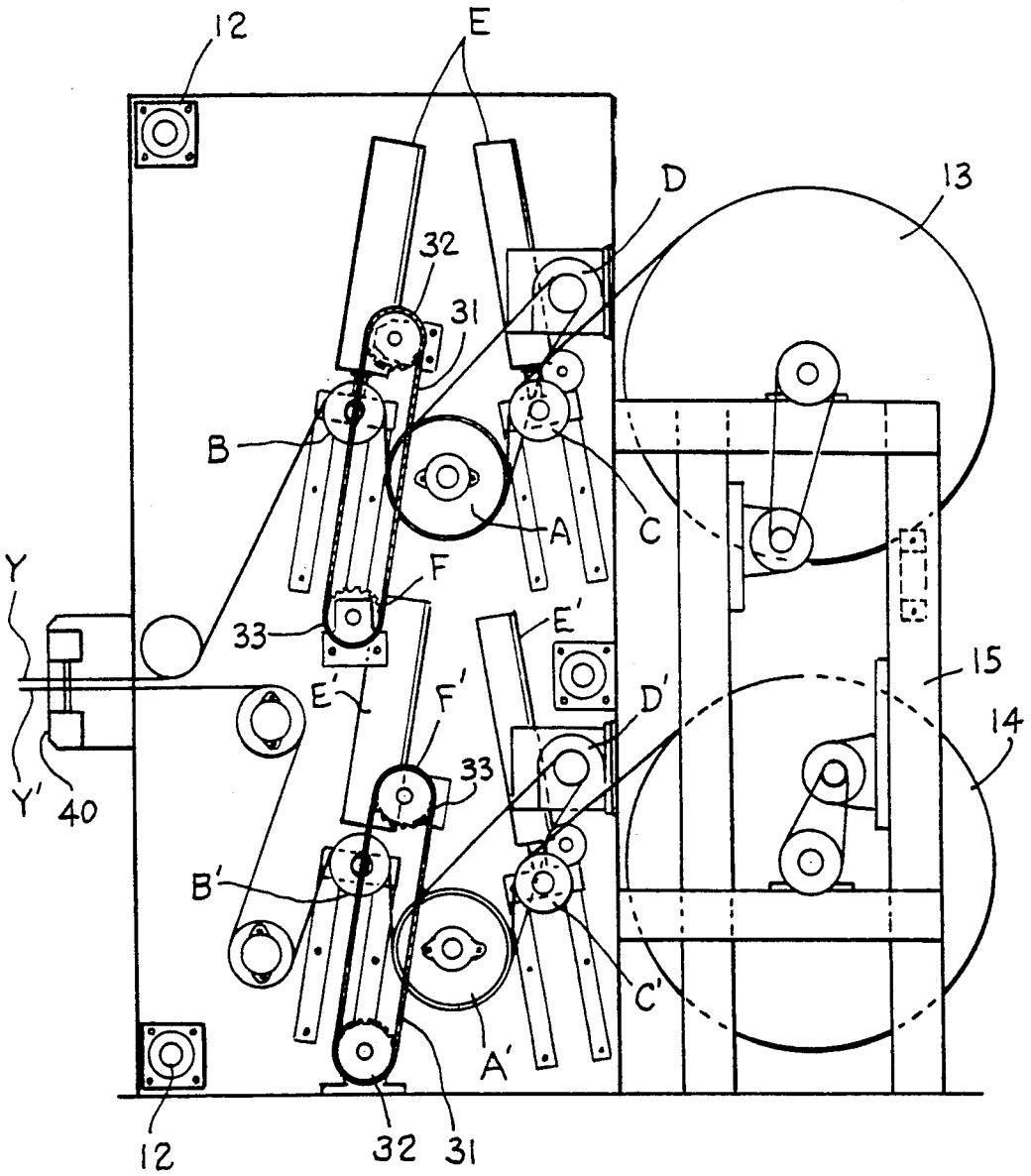
FIG. 2 is a sectional elevation taken on the line 2—2 in FIG. 1 illustrating control mechanism including the use of a potentiometer for controlling the drive to a roll over which the yarn passes for imparting hold back tension as the yarn is pulled into the weaving machine.

Referring more particularly to FIG. 1, the feeding apparatus is illustrated as including end frame members 10 and 11 having rods 12 acting as transverse frame members. The supply of warp yarn is illustrated as including warp beams 13 and 14 carried by suitable spaced frame members 15. The yarn is fed as dual webs Y and Y' on its way to the whip roll 16 (if used) of the weaving machine 17. The fabric F woven on the weaving machine is thence fed over the sand roll 18 beneath the weaver's platform 19 to a suitable cloth takeup 20 which may be center wound or surface wound on the surface winding support rolls 21 and 22 as illustrated in FIG. 1 for building the cloth or fabric roll 23. The warp yarns may be supplied from loom beams 13 and 14 as illustrated or such yarn may be supplied by creels (not shown) through yarn boards and thence to guide rolls C and C' for passage around the drive rolls A and A, respectively. The loom beams 13 and 14 are suitably braked as by motors 23 and 24. The yarn Y and Y' thence passes under the driven yarn tensioning rolls A and A' and thence to respective dancer rolls B and B'.

The dancer rolls are positioned by free wheeling pinion gears 27 at each end together with respective racks 28 for controlling the oscillatory movement up and down of the dancer rolls responsive to variation in tension in the warp yarn. The driven rolls A and A' are illustrated as by the arrows as being driven in a clockwise direction but a speed differential between the yarn and the tensioning rolls A and A' impart tension thereto through the friction covering of the rolls A and A' illustrated at 29 and 30, respectively. The coefficient of friction may be varied by selecting designated coverings for the rolls A and A' as dictated by the tensioning requirements for the warp yarn.

Figure 4:
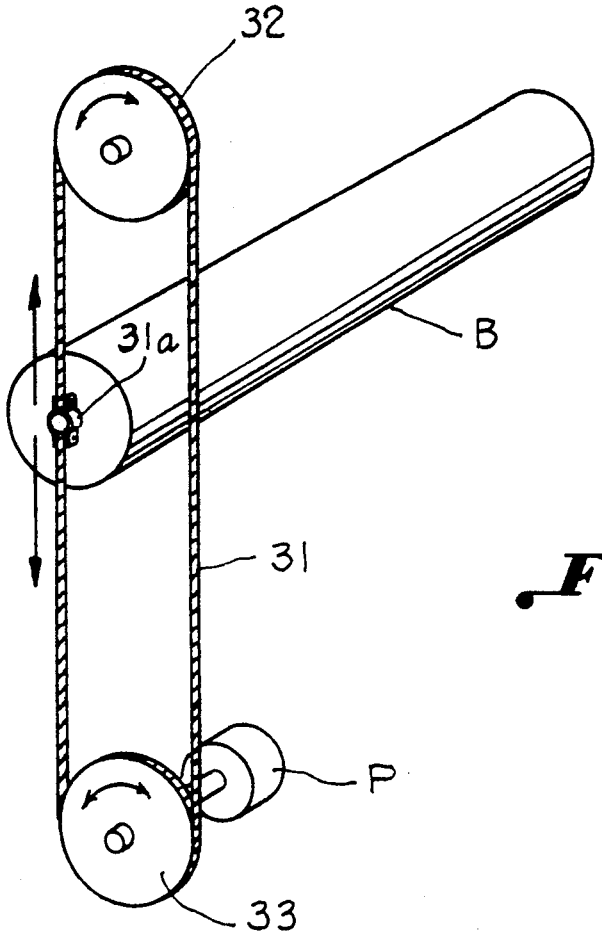
FIG. 4 is a schematic perspective view illustrating the positioning of the dancer roll for driving suitable control mechanism for varying the drive mechanism to the yarn tensioning roll.

Referring more particularly to FIG. 4, it will be observed that the dancer roll B drives a suitable roller chain 31 which has fixed connection thereto at 31*a* and which is carried by sprockets 32 and 33, respectively as illustrated in FIG. 4. The lower sprocket 33 drives a potentiometer P to control the speed of the associate motor D as illustrated in FIG. 4. As to the lower of the yarn supplying systems, the upper sprocket drives an associated potentiometer (not shown).

Figure 3:
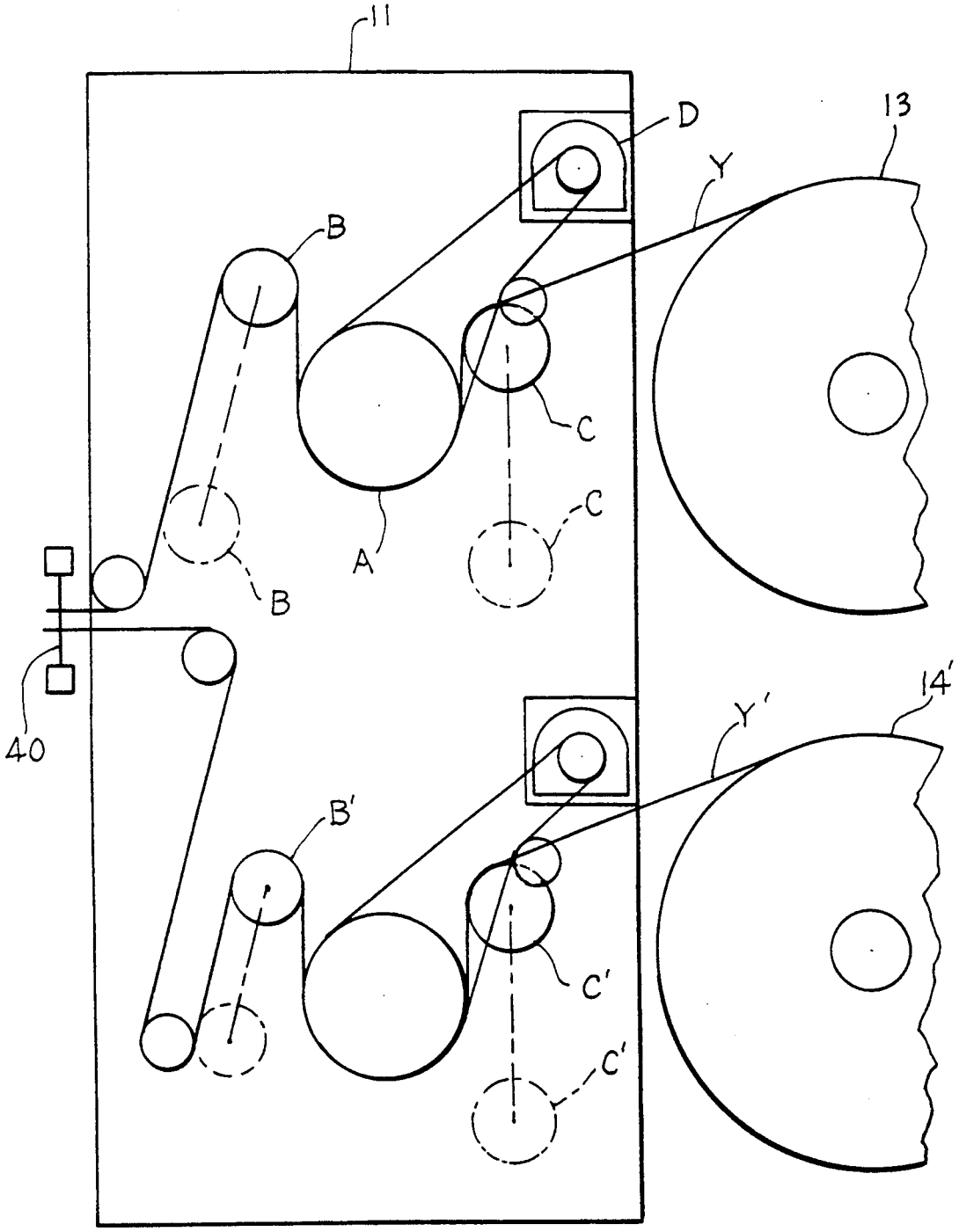
FIG. 3 is a schematic side elevation similar to FIG. 2 showing the positioning of the dancer rolls and guide rolls on either side of the driven roll for controlling the passage of warp yarn as dual webs or sheets into the weaving machine which illustrates how the various rolls can be separated to facilitate threading up of the yarn feeding apparatus.

Referring more particularly to FIG. 3, the yarn tension roll A has the associated dancer roll B and the guide roll C moved to dotted line positions by means of the power operated means including air cylinders E. Likewise, the lower yarn feeding system illustrates the dancer roll B' and the associated guide C' in spaced relation in respect to the roll A'. These systems feed the associated warp yarns Y and Y' through the yarn board 40 into the weaving machine. The yarn board which is already threaded may be moved between the spaced rolls A and A' and the associate dancer and guide rolls.

Figure 5:
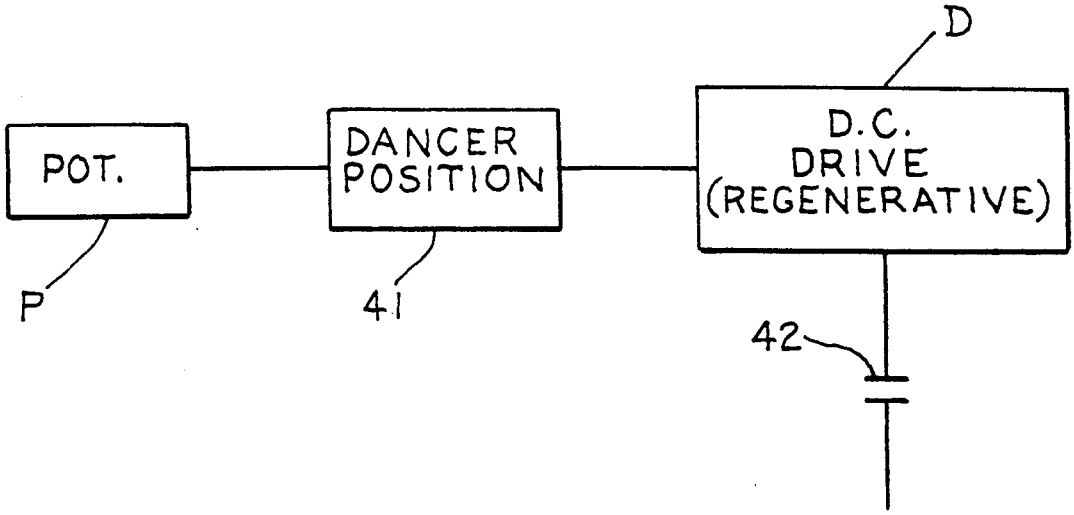
FIG. 5 is a block diagram illustrating the various electrical components for driving the mechanism for controlling the tension on the warp yarn.

Referring more particularly to FIG. 5, the block diagram illustrates a potentiometer P which feeds its output to a dancer positioning device illustrated at 41. The dancer positioning device 41 may be provided in the form of a Model D10541-000, Dancer Position Card as supplied by Carotron, Route 2, Box 405B, Highway 522, Heath Springs, S.C. 29058. The output of the dancer positioning device 41 operates a D.C. drive regenerative D. The circuitry is activated by means of normally open contacts 42 which may be referred to as the Runs Contact at the weaving machine.

It is thus seen that apparatus has been supplied which simplifies threading up of warp yarn feeders by separating the guide rolls and the dancer rolls associated therewith from the respective yarn tensioning rolls. It is also important to note that a double tensioning system may be included in the weaving machine feeding apparatus and method hereof in order to simplify the operation of obtaining proper yarn mixing and distribution. Another important object of the invention is achieved in that the warp yarn receives uniform tensioning by a simple direct application of controlled tension.

While a preferred embodiment of the invention has been described using specific terms, such description is for illustrative purposes only, and it is to be understood that changes and variations may be made without departing from the spirit or scope of the following claims.

What is claimed is:

1. In combination with a weaving machine, apparatus for feeding warp yarn from a supply into said weaving machine, the improvement comprising:

an upright frame positioned rearwardly of said weaving machine;

a driven roll receiving said warp yarn carried for rotation by said frame to tension warp yarn pulled from said supply into said weaving machine;

a dancer roll mounted for oscillatory movement receiving said warp yarn from said driven roll;

a guide for positioning said warp yarns over said dancer roll;

a motor driving said driven roll for rotation responsive to oscillatory movement of said dancer roll applying tension to said warp yarn; and apparatus moving said dancer roll and said guide away from the roll receiving said warp yarn for threading the warp yarns therebetween to the weaving machine;

whereby constant and even controlled tension is exerted across said warp yarns.

2. The structure set forth in claim 1 including a second driven roll receiving said warp yarn from a second supply, and a second dancer roll mounted for oscillatory movement.

3. The structure set forth in claim 1 including apparatus controlling the speed of said motor responsive to oscillatory movement of said dancer roll.

4. In combination with a weaving machine, apparatus for feeding warp yarn from a supply to said weaving machine, the improvement comprising:

a driven roll receiving said warp yarn;

means mounting said driven roll for rotation rearwardly of said weaving machine to tension warp yarn pulled from said supply into said weaving machine;

a dancer roll;

means mounting said dancer roll receiving said warp yarn from said driven roll;

means guiding said warp yarns over said dancer roll;

means exerting a controlled force on said dancer roll applying tension to said warp yarn; and means controlling the rotation of said driven roll responsive to oscillatory movement of said dancer roll;

whereby constant and even controlled tension is exerted across said warp yarns.

5. The structure set forth in claim 4 including a second driven roll receiving said warp yarn from a second supply, a second dancer roll mounted for oscillatory movement, and control apparatus controlling the rotation of said driven roll responsive to oscillatory movement of said dancer roll.

6. The structure set forth in claim 4 wherein said means controlling the rotation of said roll includes a potentiometer, and a drive for adjusting said potentiometer actuated by movement of said dancer roll.

7. The method of feeding warp yarn from a supply into a weaving machine comprising the steps of:

passing said warp yarn as a web under a driven roll carried for rotation rearwardly of said weaving machine;

driving said driven roll to tension warp yarn pulled from said supply into said weaving machine;

mounting a dancer roll for oscillatory movement receiving said warp yarn from said driven roll;

exerting a controlled force on said dancer roll applying tension to said warp yarn; and controlling the driving of said driven roll responsive to oscillatory movement of said dancer roll;

whereby constant and even controlled tension is exerted across said warp yarns.

8. The method set forth in claim 7 including the steps of forcefully separating said dancer roll from said driven roll and then passing said warp yarns about said driven roll.

9. The method set forth in claim 7 including the steps of passing a second web of warp yarns from another supply over a second roll, mixing said first mentioned web of warp yarns with said second web, and feeding said webs to the weaving machine.

* * * * *